United States Patent [19]

Olsson

[11] Patent Number: 4,876,962

[45] Date of Patent: Oct. 31, 1989

[54] PROPELLANT CHARGE FOR CANNONS AND A METHOD OF PRODUCING SUCH A CHARGE

[75] Inventor: Mats Olsson, Karlskoga, Sweden

[73] Assignee: Nobel Kemi AB, Karlskoga, Sweden

[21] Appl. No.: 227,565

[22] Filed: Aug. 3, 1988

[30] Foreign Application Priority Data

Aug. 21, 1987 [SE] Sweden ..... 8703246

[51] Int. Cl.[4] ..... C06B 45/12

[52] U.S. Cl. ..... 102/288; 102/286; 102/292

[58] Field of Search ..... 102/286, 288, 292

[56] References Cited

U.S. PATENT DOCUMENTS

| | | | |
|---|---|---|---|
| 660,567 | 10/1900 | Gathmann | 102/20 |
| 660,568 | 10/1900 | Gathmann | 102/292 |
| 776,652 | 12/1904 | Emery | 102/286 |
| 1,077,320 | 11/1913 | Walsh | 102/292 |
| 3,429,264 | 2/1969 | Oversohl et al. | 102/100 |
| 3,918,365 | 11/1975 | Arribat | 102/287 |
| 4,094,248 | 6/1978 | Jacobson | 102/288 |
| 4,519,855 | 5/1985 | Leneveu et al. | 102/288 X |

FOREIGN PATENT DOCUMENTS 2573751 11/1964 France .

*Primary Examiner*—Peter A. Nelson

*Attorney, Agent, or Firm*—Pollock, Vande Sande & Priddy

[57] ABSTRACT

The disclosure relates to a propellant charge for cannons comprising bundles (11) of tightly held tubular propellant sticks which are provided with connections between the propellant sticks' outer surfaces and their combustion channels, these connections consisting of either longitudinal slits or of uniformly spaced, weakened points in the form of perforations, slits, open notches or bored holes which extend from the outer surfaces of the propellant sticks to the combustions channels, the bundles (11) being surrounded by disoriented powder flakes, powder grains or short powder rods or tubes (9), these filling the remaining portion of the combustion space (7).

The disclosure also relates to a method of producing such a charge.

18 Claims, 1 Drawing Sheet

PROPELLANT CHARGE FOR CANNONS AND A METHOD OF PRODUCING SUCH A CHARGE

TECHNICAL FIELD

The present invention relates to a propellant charge for cannons which may be given high charge density and high progressivity, and also to a method of producing such a charge.

BACKGROUND ART

As a rule, propellant charges for cannons consist either of loose grains of flakes, rods or perforated cylinders, or of sticks with or without perforations enclosed in a case or cartridge, in which the length of the perforated propellant sticks has, for combustion reasons, hitherto been generally limited to a maximum of 100 times the diameter of the powder's inner-channels. Moreover, charges of this type are often composed of mixtures of different batches of two or more powders. In this context, it is of minor importance whether the powder is—from the purely chemical point of view of the single, double or varying triple-base type or whether or not the surface is coated or inhibited.

Hence, the present invention now relates to propellant charges for cannon ammunition which may be given an extremely high charge density and high progressivity, the invention also relating to a method of producing such charges.

Generally speaking, a normal propellant may be considered as having a specific gravity of approx 1.53. In charges consisting of propellant of loose grains or sticks of the above-mentioned types, a charge density of approx 0.9 g/cc will be attained. On the other hand, according to the present invention, it will be possible to produce charges with charge densities of up to 1.4 g/cc i.e a considerable increase. This may be of value in those cases where the strength parameters and performance of a cannon, for example a howitzer, a tank gun or a naval gun, enable the weapon to withstand larger propellant charges than could be accommodated in the chamber of the weapon if the powder were in the loose state or in sticks. Thus, the charge according to the present invention would make it possible to improve the performance of older high-quality artillery pieces.

According to the present invention propellant charges for cannons are proposed which consist of a number of tubular propellant sticks of large length in relation to the diameter of their combustion channels and partly of loosely disposed, disoriented grains, flakes or single- or multiperforated short tubes of propellant. According to the present invention this type of charge is made possible because the propellant sticks are provided with slits or incisions which connects the propellant sticks' burning channels with their outer surfaces.

The present invention can be described in more detail as propellant charges composed, in the first instance, of a bundle or a collection of linearly arranged bundles of densely packed stick propellant of a total length corresponding at least to the major fraction of the available combustion space, and in which each stick consists of a single- or multiperforated propellant stick which has been provided at predetermined distances throughout its entire length, with points of weakness in the form of cross-sectional slits, open grooves or bored holes which extend, from the outside of the propellant stick at least as far as its centre, or alternatively where every propellant stick is provided with longitudinal, continuous or intermittent slits from the outside of the stick into all of its longitudinal burning channels. The advantage inherent in such weakened portions is that the sticks will, during the initial phase of the combustion, be shattered transversally across these weakened points by the internal gas pressure, whereafter combustion of this part of the charge will be effected in the same manner as a charge consisting initially of perforated propellant grains of short lengths.

The second alternative, which has longitudinal, continuous or intermittent slits, gives a propellant which normally burns degressively since it also burns along the slits and the burn area, and thus gas production, diminishes continuously. However, the other aspects of the invention allow the degressivity to be compensated for.

As has already been mentioned, another aspect of the present invention relates to the grain, flake-, tube or rod-shaped powder which fills out the remaining portion of the available charge space. This amount of loose powder may, if desired, be compacted around the bundle or bundles of propellant sticks. According to the present invention, the propellant stick bundles suitably consist of 1-, 7-, 19- or 37-hole perforated powder of optimal outer configuration. Other forms and numbers of perforations may also come into consideration.

A propellant charge of the type according to the present invention may be given an extremely high charge density, in that a considerable part of its total volume consists of densely packed tubular propellant sticks. If, moreover, these sticks are exteriorly inhibited by a substance of lower burning speed than the propellant, this part of the charge will obtain a very high progressivity in that the propellant sticks will, at least initially, be burned from the inside with a consequently successively increasing burning area. When the inhibiting substance has been consumed, there will, moreover, be obtained a large stepwise increase in the burning area which makes for further increased gas generation. The previously mentioned weakenings of the propellant sticks are suitably applied at separations of between 10 and 100 times the diameter of the inner burning channels of the tubular propellant. The burning channels of the tubular propellant should preferably be connected with at least every second one of these weakened points.

As a result of the weakened points, there will be obtained a rod-shaped tubular propellant which, in terms of handling and during the ignition phase, will function as a tubular propellant of full length, but which, during burning becomes shattered and is ultimately totally combusted as though it consisted of a normal tubular propellant cut into short lengths. Otherwise, tubular propellant of long lengths shows a marked tendency, after a brief period of combustion, to be shattered by the internal gas pressure into irregular fragments which readily give rise to disastrous pressure peaks in the barrel.

This problem is wholly obviated according to the present invention. One type of weakening which has been established as being particularly advantageous comprises a symmetrically disposed perforation of determined width and completely executed without the removal of any propellant. Thus, such a perforation rather assumes the form of a central incision. Since the perforation leaves a certain amount of propellant on either side, the tubes may retain nevertheless a high degree of cohesion and rigidity. Moreover, in multi-hole propellant, it is often possible to cover, with one single incision, all combustion channels, which ensures a rapid internal overall ignition, effective cracking zones and high charge weight while still imparting superior initial cohesion to the tubes.

As was mentioned above, the weakened propellant sticks will be burnt in the same manner as a corresponding amount of tubular propellant originally cut into shorter pieces, apart from the fact that this burning takes place within an overall smaller volume, since the propellant sticks according to the present invention are, from the outset, concentrated within a smaller volume than would have been the case in loosely disposed, shorter tubular propellant rods.

Another way to prevent the very long propellant sticks from breaking in an uncontrolled manner during combustion is thus to provide every burning channel with a longitudinal slit through to the outside surface, but the propellant will, as already stated, then become degressive.

The primary task of that portion of the charge according to the present invention which consists, from the outset, of loosely disposed, i.e. disorientated flakes, powder grains or short powder rods or tubes lying around the aligned sticks and which may be compacted within reasonable limits is to ensure a rapid total ignition of the entire charge and a rapid initial gas generation. It is also a simple matter to use loose powder to fill out those parts of a throated case which may not be filled, without difficulty, with densely packed bundles of propellant sticks.

The mixture of weakened tubular propellant and one or more types of loosely disposed powder provides moreover considerable opportunities for controlling the combustion process at the desired pressure vs time cycle in the barrel.

The simplest method of filling a case with a propellant charge according to the present invention is based on the procedure of first arranging one or more bundles of long propellant sticks whose total outer diameter generally corresponds to the inner diameter of the throat of the case, or other desired outer dimension, whereafter the bundle, or the bundles, is passed down into the case and the remaining space within the case is filled with loose powder.

It is also conceivable according to the present invention to dispose tubular bundles of propellant sticks such that the loose powder is filled in the middle of the charge. Furthermore, a certain portion, for example the rear half of a cartridge case, may be filled with densely packed weakened tubular propellant sticks and the remainder with powder grains or flakes of any optional type.

BRIEF DESCRIPTION OF THE ACCOMPANYING DRAWINGS

The present invention has been defined in the appended claims and will now be described in greater detail in conjunction with the accompanying drawings:

DESCRIPTION OF PREFERRED EMBODIMENT

Figure 1:
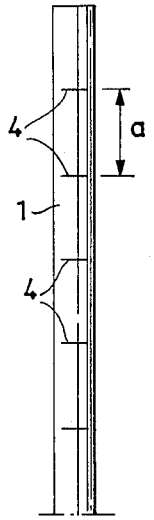
FIG. 1 shows a portion of a propellant stick weakened perpendicular to the longitudinal axis.
Figure 2:
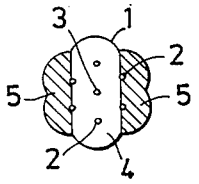
FIG. 2 shows, on a larger scale, a section through one such example of weakened rosette-shaped propellant stick.

Referring to the drawings, the propellant stick or strand 1 shown in FIG. 1 consists of a seven hole perforated rosette-shaped propellant stick weakened by perforations whose cross-section (on a larger scale) will be apparent from FIG. 2. Thus, the propellant stick 1 is provided with longitudinal burning channels consisting of six edge channels 2 and one centre channel 3, the stick being further provided with a number of through-perforations 4.

The distance between two weakened points, in the present context perforations of the propellant stick, is designated a in FIG. 1. This distance corresponds to a suitable length for a tubular propellant. The reason for this is that the length should not be too great, since otherwise it could give rise to critical gas speeds near the discharge mouths of the channels. As soon as gas generation has become initiated, the propellant sticks according to the present invention will be shattered at the weakened points. These thus ensure a complete total ignition along the channels 2 and 3 and serve as fracture zones when the gas pressure rises.

FIG. 2 illustrates a particularly advantageous method of weakening, for example, rosette-shaped sticks, shown in the figure as a 7-hole rosette-shaped stick weakened by means of a centrally placed total perforation 4 without the removal of any propellant, in which each perforation 4 passes through all of the burning channels 2 and 3 of the propellant but leaves a sufficient amount of propellant 5 on either side of the perforation in order for the propellant to retain good stability. The propellant stick illustrated in FIG. 1 is treated in this manner.

Figure 4:
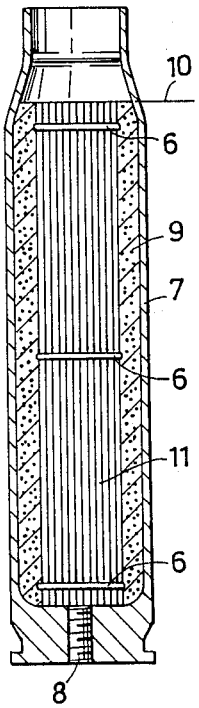
FIG. 4 shows, on a smaller scale, a longitudinal projection, partially in section, of a case charged according to the present invention.
Figure 3:
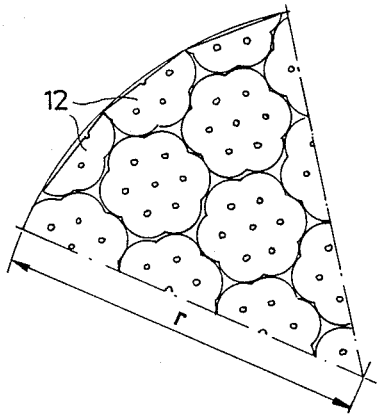
FIG. 3 is an end elevation of densely packed propellant sticks.

As will be apparent from FIG. 3, propellant sticks 12 split in the longitudinal direction may be used as filler along the periphery of the propellant stick bundles. Special bands for retaining the bundled configuration of the propellant sticks are designated by 6 in FIG. 4. FIG. 4 also shows a case 7 with its associated primer 8; 9 relates to loosely packed, disorientated propellant grains in the form of flakes, rods or tubes of short length.

Thus, in the alternative illustrated in FIG. 4, the charge consists, on the one hand, of a bundle of tubular sticks (11) weakened in the manner described above and/or possessing longitudinal slits, whose total outer diameter is not greater than the inner diameter of the neck of the case, and, on the other hand, of loosely packed propellant 9. In this case, the propellant stick bundle is of full length, i.e. it extends from the bottom of the case to the lowest position 10 of the projectile proper in the case. However, it is also conceivable that the charge may be divided up into several sub-charges. The loose propellant 9 may possibly be slightly compacted. As has been mentioned in the foregoing, any number of other combinations between a bundle of weakened or longitudinally slotted, tubular propellant sticks and loosely packed propellant may be employed for producing charges which give the desired pressure vs time cycle in every individual case.

What we claim and desire to secure by Letters Patent is:

1. A propellant charge for cannons, wherein it comprises a number of tubular propellant sticks (1) of large length in relation to the diameters of the propellant combustion channels included therein, each one of said tubular propellant sticks having been provided with slits or slots or incisions (4) which connect the propellant sticks outer surface with the respective combustion channel, and said propellant sticks having been densely packed to form one or more linearly disposed bundles of optional outer configuration and with a total length corresponding to at least the major fraction of the available charge space for the charge under consideration, whilst the remainder of the available charge space is taken up by loosely added, disorientated powder flakes, powder grains or short powder rods or tubes (9).

2. A propellant charge for cannons according to claim 1 wherein the slits or incisions (4), which connect the combustion channels to the outer surface of the propellants sticks, are uniformly distributed, and take the form of perforations, slits, open notches or bored holes which extend from the outside of the propellant sticks into at least their centre axes.

3. The propellant charge as claimed in claim 1, wherein the propellant sticks (1) forming bundles (11) consist of 7-, 19- or 37-hold rosette-shaped propellants.

4. The propellant charge as claimed in claim 1, wherein the bundled propellant sticks (1) are surface-inhibited by a substance of lower burning speed than the propellant as such.

5. The propellant charge as claimed in claim 1, wherein the loosely added, disorientated propellant (9) outside the bundled propellant sticks is compacted to a density higher than that obtained without compression.

6. A method of producing a propellant charge for cannons as claimed in claim 1, wherein tubular propellant stocks are provided with connections from the propellant sticks' outer surface to the respective combustion channels in the form of perforations, slits, open notches or bored holes whereafter these, cut to desired lengths, are joined together to form a densely packed bundle, tube or other outer configuration, and are disposed in a case, cartridge or the like intended therefore, whereafter the remaining portion of the available combustion space is filled with disorientated powder flakes, powder grains or short powder rods of tubes.

7. The method as claimed in claim 6, wherein the charge is composed of a plurality of linearly disposed bundles of tubular propellant sticks, whereafter the remainder of the charge space is filled with loose disoriented flakes, powders grains or short powder rods or tubes.

8. The method as claimed in claim 6, wherein the loosely disposed propellant is compacted to a bulk density higher than that obtained without compression.

9. The propellant charge as claimed in claim 2, wherein the propellant sticks forming bundles consist of 7-, 19-, or 37-hole rosette-shaped propellant.

10. The propellant charge as claimed in claim 2, wherein the bundled propellant stocks are surface-inhibited by a substance of lower burning speed than the propellant as such.

11. The propellant charge as claimed in claim 3, wherein the bundled propellant stocks are surface-inhibited by a substance of lower burning speed than the propellant as such.

12. The propellant charge as claimed in claim 2, wherein the loosely added, disorientated propellant outside the bundled propellant sticks is compacted to a density higher than that obtained without compression.

13. The propellant charge as claimed in claim 3, wherein the loosely added, disorientated propellant outside the bundled propellant sticks is compacted to a density higher than that obtained without compression.

14. The propellant charge as claimed in claim 4, wherein the loosely added, disorientated propellant outside the bundled propellant sticks is compacted to a density higher than that obtained without compression.

15. A method of producing a propellant charge for cannons as claimed in claim 2, wherein tubular propellant stocks are provided with connections from the propellant sticks' outer surface to the respective combustion channels in the form of perforations, slits, open notches or bored holes whereafter these, cut to desired lengths, are joined together to form a densely packed bundle, tube or other outer configuration, and are disposed in a case, cartridge or the like intended therefore, whereafter the remaining portion of the available combustion space is filled with disorientated powder flakes, powder grains or short powder rods or tubes.

16. A method of producing a propellant charge for cannons as claimed in claim 3, wherein tubular propellant stocks are provided with connections from the propellant sticks' outer surface to the respective combustion channels in the form of perforations, slits, open notches or bored holes whereafter these, cut to desired lengths, are joined together to form a densely packed bundle, tube or other outer configuration, and are disposed in a case, cartridge or the like intended therefore, whereafter the remaining portion of the available combustion space is filled with disorientated powder flakes, powder grains or short powder rods or tubes.

17. A method of producing a propellant charge for cannons as claimed in claim 4, wherein tubular propellant stocks are provided with connections from the propellant sticks, outer surface to the respective combustion channels in the form of perforations, slits, open notches or bored holes whereafter these, cut to desired lengths, are joined together to form a densely packed bundle, tube or other outer configuration, and are disposed in a case, cartridge or the like intended therefore, whereafter the remaining portion of the available combustion space is filled with disorientated powder flakes, powder grains or short powder rods or tubes.

18. A method of producing a propellant charge for cannons as claimed in claim 5, wherein tubular propellant stocks are provided with connections from the propellant sticks' outer surface to the respective combustion channels in the form of perforations, slits, open notches or bored holes whereafter these, Cut to desired lengths, are joined together to form a densely packed bundle, tube or other outer configuration, and are disposed in a case, cartridge or the like intended therefore, whereafter the remaining portion of the available combustion space is filled with disorientated powder flakes, powder grains or short powder rods or tubes.

* * * * *